US005667405A

United States Patent [19]

Holliday

[11] Patent Number: 5,667,405

[45] Date of Patent: Sep. 16, 1997

[54] COAXIAL CABLE CONNECTOR FOR CATV SYSTEMS

[76] Inventor: Randall A. Holliday, 10045 Mead Ct., Westminster, Colo. 80030

[21] Appl. No.: 593,736

[22] Filed: Jan. 29, 1996

Related U.S. Application Data

[63] Continuation-in-part of Ser. No. 210,480, Mar. 21, 1994, Pat. No. 5,501,616.

[51] Int. Cl.[6] ..... H01R 9/07

[52] U.S. Cl. ..... 439/585; 439/271; 439/578

[58] Field of Search ..... 439/578–585, 439/675, 271–283

[56] References Cited

U.S. PATENT DOCUMENTS

| | | | |
|---|---|---|---|
| 3,668,612 | 6/1972 | Nepovim | 439/584 |
| 3,686,623 | 8/1972 | Nijman | 439/584 |
| 4,444,453 | 4/1984 | Kirby et al. | 439/583 |
| 5,269,701 | 12/1993 | Leibfried, Jr. | 439/578 |

*Primary Examiner*—David L. Pirlot
*Attorney, Agent, or Firm*—John E. Reilly

[57] ABSTRACT

A coaxial cable connector for connecting a coaxial cable to a terminal port wherein a connector sleeve assists in retaining an end of the coaxial cable, and a coupling member between the sleeve and the port draws the sleeve into flush engagement with an end of the port, an improved sealing device is provided in which an annular seal member is interposed between a grooved portion on the forward end wall of the sleeve, the annular end of the port and within the coupling member, the seal being of a size greater than the groove and being partially compressed into the groove when the sleeve and port are drawn together so as to prevent moisture infiltration through the connecting interfaces between the coupling and connector as well as the coupling and port; and an extension wall of the connector which surrounds the end of the coaxial cable is selectively increased in thickness so as to prevent its collapse when a crimping force is applied to the extension wall.

15 Claims, 1 Drawing Sheet

COAXIAL CABLE CONNECTOR FOR CATV SYSTEMS

CROSS REFERENCE TO RELATED APPLICATIONS

This application is a continuation-in-part application for END CONNECTOR FOR COAXIAL CABLE, Ser. No. 210,480, filed 21 Mar., 1994, by Randall A. Holliday, U.S. Pat. No. 5,501,616.

BACKGROUND AND FIELD OF INVENTION

This invention relates to fittings for CATV systems; and more particularly relates to a novel and improved coaxial cable connector for electrically and mechanically connecting a fitting in sealed engagement with a coaxial cable.

Coaxial cables are generally characterized by being made up of inner and outer concentric conductors separated by a dielectric insulator and encased or covered by an outer jacket of rubber or rubber-like material. Numerous types of end connectors have been devised to effect a secure mechanical and electrical connection to the end of the coaxial cable and in such a way that the inner conductor and dielectric insulator extend through an inner sleeve of the connector while the outer conductor and jacket are inserted into an annular space between the inner sleeve and an outer concentric sleeve. The outer concentric sleeve is then crimped in a radial inward direction to securely clamp the end of the cable within the connector, and a fastener on the opposite end of the connector is then connected to the post or terminal.

I have previously devised a cable connector which is capable of establishing uniform sealed engagement between the coaxial cable and the connector end as well as secure a mechanical coupling between the elements while avoiding the necessity of using separate seals or materials and attention is directed to my hereinbefore referred to copending application for patent Ser. No. 210,480 entitled END CONNECTOR FOR COAXIAL CABLE. Nevertheless, there are many applications where the connector is exposed to moisture which requires a special seal between the inner conductor body or post of the end connector and the fastener or interface into the CATV terminal. It is extremely important in such applications that a sealing element be provided which is capable of preventing entry of water or moisture via the threading or nut at the interface between the connector body and port or fastener into the terminal but to insure the broadest possible surface area of engagement between the connector body and port inwardly of the seal to maintain most efficient electrical signal transmission into the port from the cable and minimize radiation leakage. Still further, it is important and highly desirable to strengthen the post or connector body against collapse when subjected to axial loading during the crimping operation.

SUMMARY OF INVENTION

It is therefore an object of the present invention is to provide for a novel and improved coaxial cable connector which is capable of achieving an improved weather-tight seal between a connector body and port; and further wherein the seal is capable of preventing moisture infiltration, minimizing radiation leakage and effecting a broad surface area of engagement between the connector body and port while positively retaining the sealing element in position for most effective sealing.

It is another object of the present invention to provide for a novel and improved coaxial cable connector in which a connector body is so constructed and arranged as to minimize axial collapse when subjected to crimping and is capable of effecting a positive seal against moisture infiltration as well as radiation leakage between the connector body of the connector terminal.

A further object of the present invention is to provide for a novel and improved coaxial cable connector which is conformable for use with different cable diameters and is deformable into uniformly sealed engagement with one end of the cable as well as effecting sealed engagement between the connector fitting and port so as to establish a weather-tight seal when exposed to the elements.

The present invention is specifically intended for use in a coaxial cable connector for connection to a terminal port wherein an annular connector sleeve assists in retaining an end of a coaxial cable therein and a coupling member draws a first annular end of the sleeve into flush engagement with a correspondingly sized second annular end of the port, the improvement comprising a forwardly extending wall portion on the first annular end which is provided with a radially outwardly facing circumferential groove, and an annular seal member is interposed between the groove and the coupling member, the seal being of a size greater than the groove and being partially compressed into the groove when the coupling member draws the wall portion into flush engagement with the second annular end of the port. In this way, the seal member will prevent moisture infiltration through the space between the coupling and connector as well as the coupling and port. In addition, an extension of the connector body which surrounds the coaxial cable is increased in thickness at its juncture with the connector body to prevent its collapse when a crimping force is applied to the extension.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
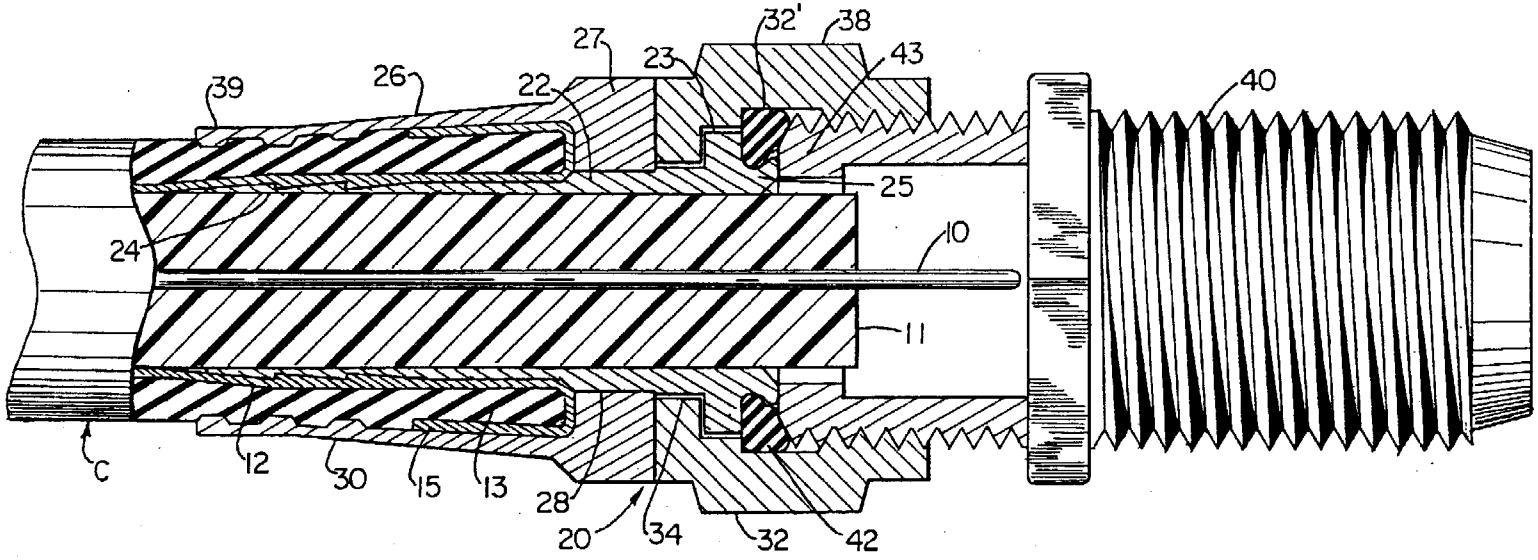
FIG. 1 is a view partially in section of a coaxial cable connector assembled onto a port of a TV terminal in accordance with the present invention.

Referring now to the drawings, a conventional form of coaxial cable C is made up of an inner conductor 10, a dielectric insulator 11, outer braided conductor 12 and dielectric jacket 13 composed of rubber or rubber-like material. In accordance with well-known practice, in order to effect connection of the cable to a post or terminal, the end of the inner conductor 10 is exposed by removing a limited length of the dielectric insulator 11, and a limited length 15 of the conductor 12 is peeled back from the insulator 11 and doubled over the outer jacket 13. The standard cable C, including those used in the cable television industry, has different outer diameters, principally on account of different thicknesses employed in the outer braided conductor 12. For instance, an RG Series 59 cable may be on the order of 0.035" smaller in diameter than an RG 6 cable, and each series cable may vary approximately 0.025" owing primarily to the difference in thickness of the braided conductor layer 12.

Figure 2:
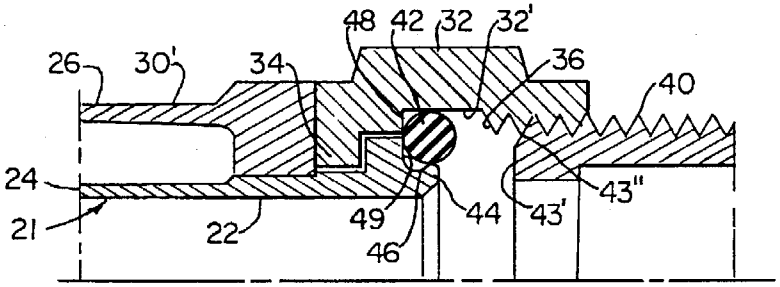
FIG. 2 is a fragmentary sectional view of the coupling portion of the connector shown in FIG. 1 prior to tightening of the connector onto an end of a terminal.

As shown in FIGS. 1 and 2 a connector 20 is of a type specifically adapted for outdoor use and has an inner connector sleeve or post 21 including a sleeve body 22 at its forward end, an external shoulder or flange 23 terminating in a grooved forward end wall portion 25, and a rearward extension 24 of reduced diameter and wall thickness in relation to the sleeve body 22. An outer sleeve 26 has a body 27 with an internal flange or shoulder 28 in surrounding relation to the sleeve body 22 and a rearward extension 30 which tapers rearwardly away from the body 27 in outer spaced concentric relation to the inner sleeve extension 24 so as to form an annular space therebetween for insertion of the conductor layer 12 and the jacket 13. The extension 30 is of increased thickness as at 30' adjacent to its juncture with the shoulder 28 for a purpose to be described. External surface 39 of the extension 30 is a smooth, non-ribbed continuous surface to facilitate gripping and crimping in a manner to be described.

A fastener or coupling member 32 at the forward end of the connector 20 has a radially inwardly directed shoulder 34 at its rearward end which is interposed between the external shoulder 23 of the inner sleeve body 22 and the outer sleeve body 27 and which normally is freely rotatable with respect to the inner and outer sleeve members 21 and 26. The fastener 32 is internally threaded as at 36 throughout its greater length and is provided with external flats 38 to facilitate engagement by a hand wrench or other tool for the purpose of threading onto an externally threaded hollow stem which defines a port 40 of a terminal, not shown.

As noted earlier, the connector 20 of the present invention is adapted for outdoor use and, to this end, a seal member 42 is interposed between the external flange 23 of the sleeve or connector body 22, the coupling member 32 and annular end portion 43 of the port 40. The annular end portion 43 is provided with a squared end wall surface 43' in facing relation to the forward end wall portion 25 of the connector body 22, and a radially outer surface 43" diverges forwardly away from the end surface 43' into the external threading on the port 40. In turn, the forward end wall portion 25 defines a forward annular extension of the radially inner portion of the flange 23 and terminates in an annular lip 44 which diverges radially and outwardly. The forward extremity of the lip is disposed in facing relation to the end surface of the annular end 44 on the port 40, and the lip 44 defines with the flange 23 a circumferential groove 46 of generally U-shaped cross-sectional configuration which diverges somewhat radially and outwardly toward the seal member 42. A stepped portion 34' extends forwardly from the shoulder 34 in outer circumferential relation to the shoulder 23 and terminates in a radial wall surface 48 which is aligned with radial wall surface 49 of the shoulder 23 on one side of the groove 46.

The seal member 42 is in the form of an O-ring which is of circular cross-sectional configuration and normally of a configuration shown in FIG. 2. The O-ring is sized to fit snugly between the lip 44, flange 23 and inner wall surface 32' of the flange 32, and surface 43" of the port 40. When the fastener 32 is tightened by threading onto the port 40, the seal member 42 is compressed by the annular end 43 of the port 40 into the groove 46 as well as to fill the space across the flange 23 and the stepped portion 34' of the shoulder 34; and further will expand somewhat radially and forwardly across the radially outer surface 43" when the end surface portion 43 is advanced into flush engagement with the flat end surface of the lip 44. As a result, the single seal member 42 prevents moisture infiltration through the space between the flange 23 and coupling 32 as well as between the coupling 32 and port 40. At the same time, the lip 45 defines a broad surface area of engagement with the annular end portion 43 to assure good electrical conductivity between the sleeve body 22 and port 40.

In order to attach the end connector 20 onto the end of the cable C, the cable is inserted into the end connector 20 with the exposed inner conductor 10 and insulator 11 extending through the inner sleeve 21 and the outer braided conductor 12 and jacket 13 extending through the annular space 31 between the reduced rearward extension 24 of the inner sleeve 22 and the reduced outer extension 30 of the outer sleeve 26. When the cable C is fully inserted into the connector 20, the end of the jacket 13 will abut the rearward end of the flange 27 on the outer sleeve 26 and the inner conductor 10 will project slightly beyond the end of the fastener 34. Inward radial crimping of the rearward end of the extension 30 is effected by the use of a crimping tool, such as, that disclosed in my hereinbefore referred to patent application Ser. No. 992,524, now U.S. Pat. No. 5,392,508, and which will cause uniform, radially inward reduction in diameter of the rearward end, or crimping zone, which is that area surrounding the spaced rings 40, into uniform sealing engagement with the jacket 13. As the rearward extension 30 is crimped, the crimping tool applies an axially directed force along the inner and outer sleeves 22 and 26 toward the leading end which will tend to collapse the sleeves 22 and 26. Accordingly, as previously described, the wall thickness of the outer sleeve 26 is increased toward the sleeve body 27 to a degree sufficient to prevent its collapse when subjected to the axial force of the crimping tool.

It will be apparent that the specific configuration and arrangement of the forward end wall portion 25 and specifically the groove 46 may be modified while achieving the desired end of completely sealing the interface between the connector 10, coupling member 32 and the post 40. For example, a ring or annular ledge without a groove may be formed around the radially inner wall surface 48 which will establish the necessary conductive path with the end surface of the post while at the same time retaining the seal in the space radially outwardly of the forward end wall portion 25. Nevertheless, the groove 46 is particularly effective in retaining the seal 42 in the desired relationship and filling the space as described. It is therefore to be understood that while a preferred form of invention has been herein set forth and described, various modifications and changes may be made in the construction and arrangement of elements without departing from the spirit and scope of the present invention as defined by the appended claims and reasonable equivalents thereof.

I claim:

1. In a coaxial cable connector for connection to a terminal port wherein an annular connector sleeve assists in retaining an end of a coaxial cable, and a coupling member draws a first annular end of said sleeve into flush engagement with a correspondingly sized second annular end of said port, the improvement comprising:

said first annular end including a forwardly extending wall portion provided with a radially outwardly facing circumferential groove; and an annular seal interposed between said groove and said coupling member, said seal being of a size greater than said groove and being partially compressed into said groove when said wall portion is drawn into flush engagement with said second annular end to establish an electrically conductive path therebetween.

2. In a coaxial cable connector according to claim 1, wherein said seal member is in the form of an O-ring.

3. In a coaxial cable connector according to claim 1, wherein said seal member is sized to fill any space between said sleeve body, said coupling member and said second annular end.

4. In a coaxial cable connector according to claim 1, wherein said connector includes a connector body and an annular extension wall in surrounding relation to the end of said coaxial cable, said extension wall increasing in thickness at its juncture with said connector body.

5. In a coaxial cable connector according to claim 1, said wall portion extending from said first annular end toward said second annular end and terminating in a radially outwardly extending lip in flush engagement with said second annular end.

6. In a coaxial cable connector according to claim 2, said first and second annular ends being of a corresponding wall thickness and diameter, and a radially outer surface diverges forwardly away from said second annular end.

7. An end connector for connecting an end of a coaxial cable to a terminal post wherein said cable has inner and outer concentric conductors separated by an annular dielectric, and a portion of said outer conductor being exposed at the end of said cable, said connector comprising:

(a) inner and outer spaced concentric coaxial sleeves, said inner of said sleeves being sized for insertion of said inner conductor and said annular dielectric therein, said outer sleeve being sized for insertion of said outer conductor through one end of said connector between said inner and outer sleeves;

(b) said inner sleeve having a forward end wall portion provided with a radially outwardly directed circumferential groove;

(c) a coupling member between said inner of said sleeves and said post wherein rotation of said coupling member will draw said wall portion into flush engagement with a correspondingly sized annular end wall of said port; and (d) an annular compressible seal interposed between said wall portion, said coupling member and said port, said seal being of a size greater than said groove and being partially compressed into said groove when said wall portion is drawn into flush engagement with said annular end.

8. An end connector according to claim 7, wherein said seal member is in the form of an O-ring sized to fill any space between said inner sleeve, said coupling member and said annular end.

9. An end connector according to claim 7, wherein said outer sleeve includes a connector body abutting one end of said coupling member and an extension wall extending rearwardly from said connector body in surrounding relation to the end of said coaxial cable, said extension wall increasing in thickness at its juncture with said connector body.

10. An end connector according to claim 7, wherein said coupling member and said inner sleeve have interfitting shoulder portions defining a common radial wall surface on one side of said groove.

11. An end connector according to claim 10, wherein said coupling member is rotatable with respect to said inner sleeve.

12. In a coaxial cable connector for connection to a terminal port wherein an annular connector sleeve assists in retaining an end of a coaxial cable, and a coupling member draws a first annular end of said sleeve into flush engagement with a correspondingly sized second annular end of said port, the improvement comprising:

said first annular end including a forwardly extending wall portion provided with a ledge; and an annular seal interposed between said ledge and said coupling member, said seal being compressed between said ledge and said coupling member when said wall portion is drawn into flush engagement with said second annular end to establish an electrically conductive path therebetween.

13. In a coaxial cable connector according to claim 12, said ledge extending from said first annular end toward said second annular end and terminating in a radially outwardly extending lip in flush engagement with said second annular end.

14. In a coaxial cable connector according to claim 12, wherein said seal member is in the form of an O-ring sized to fill any space between said sleeve body, said coupling member and said second annular end.

15. In a coaxial cable connector according to claim 12, wherein said connector includes a connector body and an annular extension wall in surrounding relation to the end of said coaxial cable, said extension wall increasing in thickness at its juncture with said connector body.

* * * * *